US012751533B2

(12) United States Patent
Zhu et al.

(10) Patent No.: US 12,751,533 B2
(45) Date of Patent: Oct. 6, 2026

(54) STRAIGHTENING COMB WITH ELASTIC FLOATING TEETH

(71) Applicant: DONGGUAN JINFENG SCIENCE AND TECHNOLOGY CO., LTD., Dongguan (CN)

(72) Inventors: Yunji Zhu, Dongguan (CN); Yong Liu, Dongguan (CN)

(73) Assignee: DONGGUAN JINFENG SCIENCE AND TECHNOLOGY CO., LTD., Dongguan (CN)

( * ) Notice: Subject to any disclaimer, the term of this patent is extended or adjusted under 35 U.S.C. 154(b) by 35 days.

(21) Appl. No.: 18/896,417

(22) Filed: Sep. 25, 2024

(65) Prior Publication Data

US 2025/0338936 A1 Nov. 6, 2025

(30) Foreign Application Priority Data

May 6, 2024 (CN) ..... 202420965094.5

(51) Int. Cl.
*A45D 20/48* (2006.01)
*A45D 2/00* (2006.01)

(52) U.S. Cl.
CPC ..... *A45D 2/002* (2013.01); *A45D 20/48* (2013.01)

(58) Field of Classification Search
None
See application file for complete search history.

(56) References Cited

U.S. PATENT DOCUMENTS

| | | | | |
|---|---|---|---|---|
| 7,490,615 | B2 * | 2/2009 | Rizzuto | A45D 2/002 132/129 |
| 8,267,098 | B2 * | 9/2012 | Glucksman | A45D 20/48 132/137 |
| 11,019,903 | B2 * | 6/2021 | Potts | A46B 9/06 |
| 2015/0122286 | A1 * | 5/2015 | Valle | A45D 2/002 132/229 |
| 2017/0215540 | A1 * | 8/2017 | Qin | A45D 2/002 |

FOREIGN PATENT DOCUMENTS

| | | | | |
|---|---|---|---|---|
| CN | 213308009 U | | 6/2021 | |
| CN | 217039194 U | * | 7/2022 | |
| DE | 202011050030 U1 | * | 8/2012 | A45D 20/48 |

* cited by examiner

*Primary Examiner* — Tatiana L Nobrega
(74) *Attorney, Agent, or Firm* — JEEN IP LAW, LLC

(57) ABSTRACT

The present disclosure discloses a straightening comb with elastic floating teeth, comprising a shell, a heater, a tooth assembly, a control switch and a circuit board, wherein the tooth assembly comprises fixed and elastic teeth, the fixed teeth are installed fixedly in the shell, the elastic teeth are installed movably in the shell, and each elastic tooth is opposite to a fixed tooth; an elastic component is provided on the side of each elastic tooth, and presses against the side of the elastic tooth, allowing the elastic tooth to move closer to or farther away from the fixed tooth. Thus, the teeth can adapt to different hair thicknesses and fineness levels, and ensure that each hair is under an appropriate tension. This helps to distribute the straightening force evenly, prevent the over-stretching or insufficient straightening of a single hair.

9 Claims, 3 Drawing Sheets

STRAIGHTENING COMB WITH ELASTIC FLOATING TEETH

CROSS-REFERENCE TO RELATED APPLICATIONS

This application claims priority to Chinese Patent Application No. 202420965094.5, filed on May 6, 2024, which is hereby incorporated by reference in its entirety.

TECHNICAL FIELD

The present disclosure relates to the technical field of beauty care and hairdressing tools, especially to a straightening comb with floating teeth.

BACKGROUND

Straightening combs are applied extensively in the hairdressing industry and can be used to straighten hair. For example, the electric heating straightening comb disclosed in Chinese invention patent CN201510321623.3 comprises a handle and a tooth portion, wherein a heater and teeth extending out of the tooth portion are provided inside the tooth portion, and the teeth comprise upper and lower teeth. This electric straightening comb makes the upper and lower teeth heat for direct hair straightening through the contact between the heater and the teeth. Since the upper and lower teeth are stacked together alternately, the gap between adjacent teeth is reduced, allowing it to contact the hair more fully during straightening. Therefore, during hair straightening, a hairstylist does not need a comb as an aid, and does not have to hold the straightening comb tightly all the time, realizing convenient operation. However, its disadvantage is that the gap among the teeth is constant and unalterable, that is, the distance between adjacent teeth is always the same and non-adjustable, so that it may be unsuitable for all hair types or thicknesses.

For example, if the teeth are too far apart, that is, the gap is too large, it may be unable to grab thin hair effectively, thereby affecting the straightening effect. On the contrary, if the teeth are too close, that is, the gap is too small, it may be difficult to straighten dense or curly hair without causing breakage.

SUMMARY

For the disadvantages of the prior art, the present disclosure provides a straightening comb with elastic floating teeth with a more reasonable structural design that adjusts the gap among the teeth to hair fineness, and has a better straightening effect.

To solve the above technical problem, the present disclosure proposes the following technical solution: a straightening comb with elastic floating teeth, comprising a shell, a heater, a tooth assembly, a control switch and a circuit board, wherein the tooth assembly comprises fixed and elastic teeth, the fixed teeth are installed fixedly in the shell, the elastic teeth are installed movably in the shell, and each elastic tooth is opposite to a fixed tooth; an elastic component is provided on the side of each elastic tooth, and presses against the side of the elastic tooth, allowing the elastic teeth to form a structure that can move closer to or farther away from the fixed teeth; the upper part of at least one of the elastic and fixed teeth is an inclined structure to provide a gap that accommodates the hair between the elastic and fixed teeth.

Further, the fixed teeth are provided on a comb strip, and the lower two sides of several fixed teeth are connected into an integrated structure through a fixing frame; there is a tooth hole between two adjacent fixed teeth, and the elastic teeth extend from the tooth holes opposite the fixed teeth.

Further, a group of elastic teeth is provided in each tooth hole, each group of elastic teeth comprises symmetrically arranged left and right teeth, the left teeth are opposite to the right side of the fixed teeth, and the right teeth are opposite to the left side of the fixed teeth; an elastic component is provided between the left and right teeth, and also presses against the opposite sides of the left and right teeth to form a structure that can push the left and right teeth simultaneously to move to the left and right sides simultaneously.

Further, it also comprises a comb cover, and the comb cover is provided with a partition cover and a partition tooth. There is a gap between the partition cover and the partition tooth to form a combing groove, and each combing groove corresponds to a gap for accommodating hair.

Further, the comb cover is provided on the shell, the partition cover is alternated with the partition teeth to cover the elastic teeth, and the partition teeth cover the fixed teeth.

Further, protruding stop lugs are provided at the top of the elastic teeth, stop grooves matching the stop lugs are provided inside the top of the partition cover, and the stop lugs are inserted into the stop grooves; the size of a stop groove is larger than that of a stop lug, so that the stop lug can move within the stop groove.

Further, a partition strip is provided along each fixed tooth, has the same direction as that of the fixed tooth, and extends to the bottom surface of the fixing frame on both sides; support feet are provided on the bottom surface of the elastic teeth, and blocked by the space formed by the fixing frame and the partition strips.

Further, the heater is fixed through a fixing cover, and the fixing cover seizes the fixing frame of the comb strip; a heat conducting plate is provided next to the heater, and in contact with all fixed and elastic teeth through a partition strip and a support leg respectively to form a heat conducting structure; the fixing cover is made of aluminum alloy.

Further, the shell comprises a first shell and a second shell, and the fixed and elastic teeth extend from the first shell, and the second shell covers the bottom surface of the fixing cover.

As a preferred option, the elastic component uses silicone blocks or springs.

The present disclosure provides an elastic tooth structure that can reduce or increase the tooth gap under the action of an external force and the elastic force of an elastomer, so that the teeth can adapt to different hair thicknesses and fineness levels, and ensure that each hair is under an appropriate tension. This helps to distribute the straightening force evenly and prevent the over-stretching or insufficient straightening of a single hair. This floating characteristic allows the teeth to slide through the hair smoothly, reduce friction, and minimize the risk of hair breakage, which is particularly useful for people with fragile or damaged hair. Therefore, it can provide a milder and more effective hair straightening experience, and solve the problems of insufficient tension and hair breakage.

In the figures, 11 is the first shell, 12 is the second shell, 2 is the comb strip, 21 is the fixing frame, 22 is a fixed tooth, 23 is a tooth hole, 24 is a partition strip, 3 is an elastic tooth, 31 is a left tooth, 32 is a right tooth, 33 is a support leg, 34 is a stop lug, 4 is a silicone block, 5 is the tooth cover, 51 is a partition cover, 52 is a partition tooth, 53 is a combing groove, 54 is a stop groove, 6 is the fixing cover, 7 is the heat conducting plate, and 8 is the heater.

DESCRIPTION OF EMBODIMENTS

Figure 1:
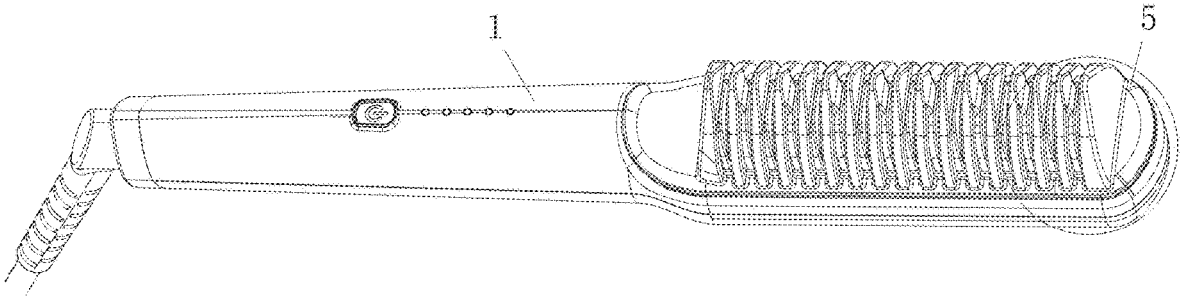
FIG. 1 is a three-dimensional exterior view of the present disclosure.
Figure 2:
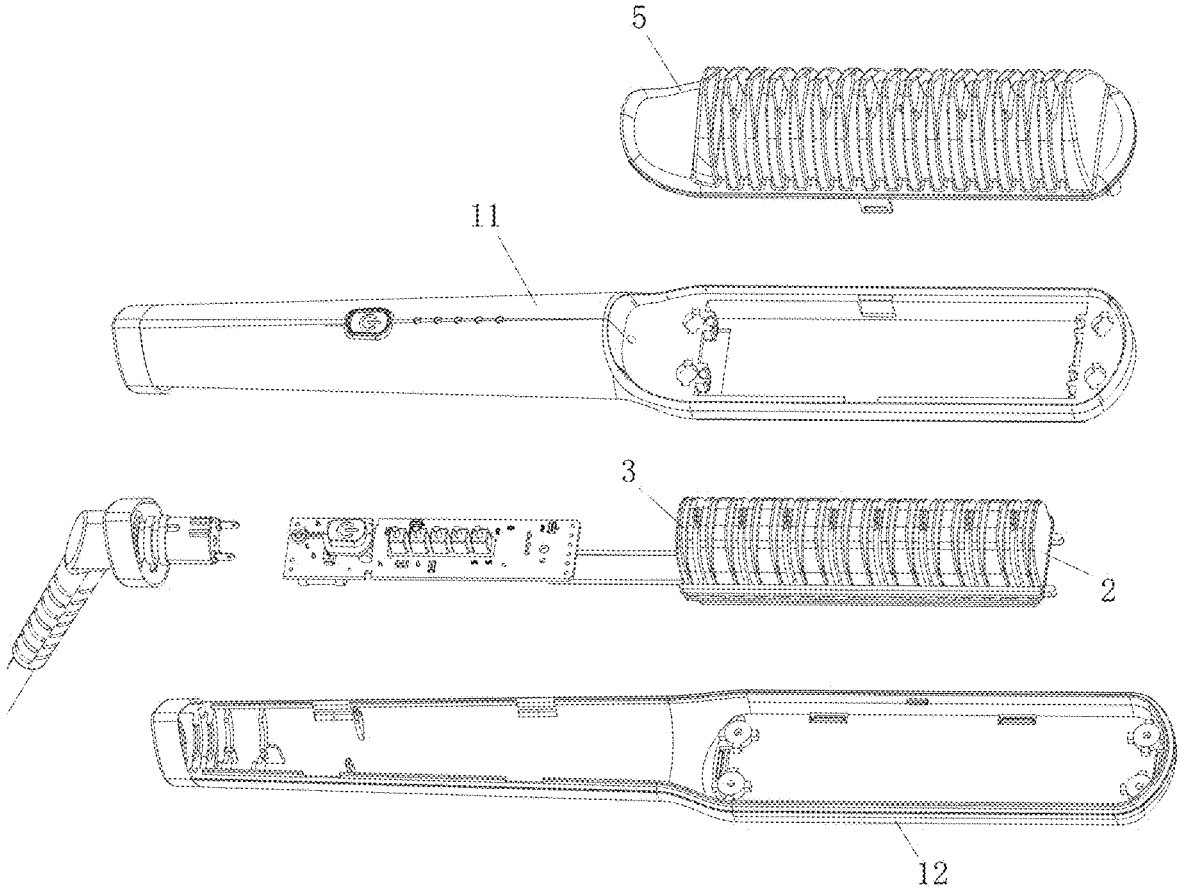
FIG. 2 is an exploded view of the present disclosure.
Figure 3:
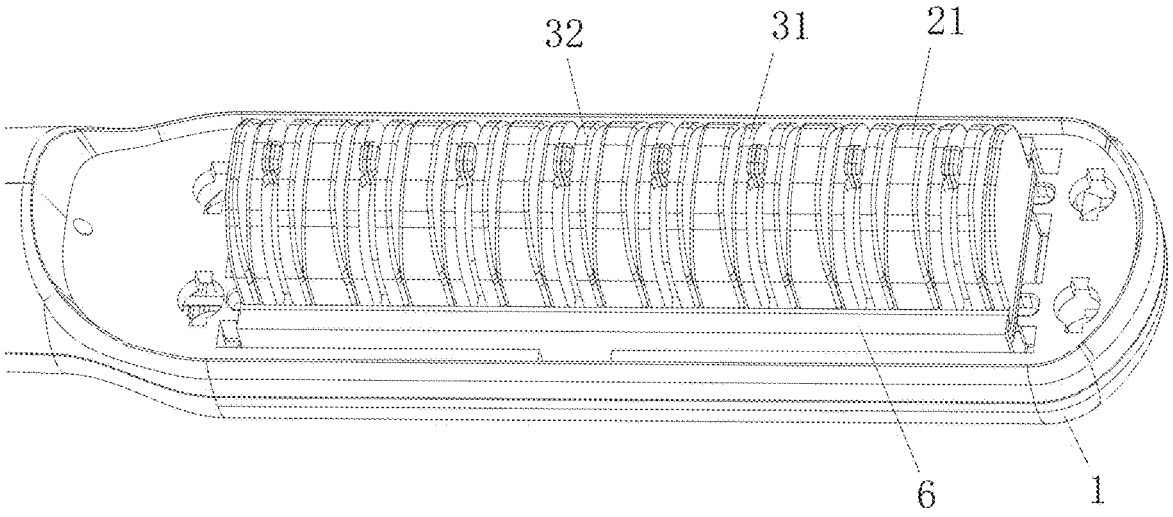
FIG. 3 is a structural diagram of the main body of the present disclosure with the tooth cover removed.
Figure 4:
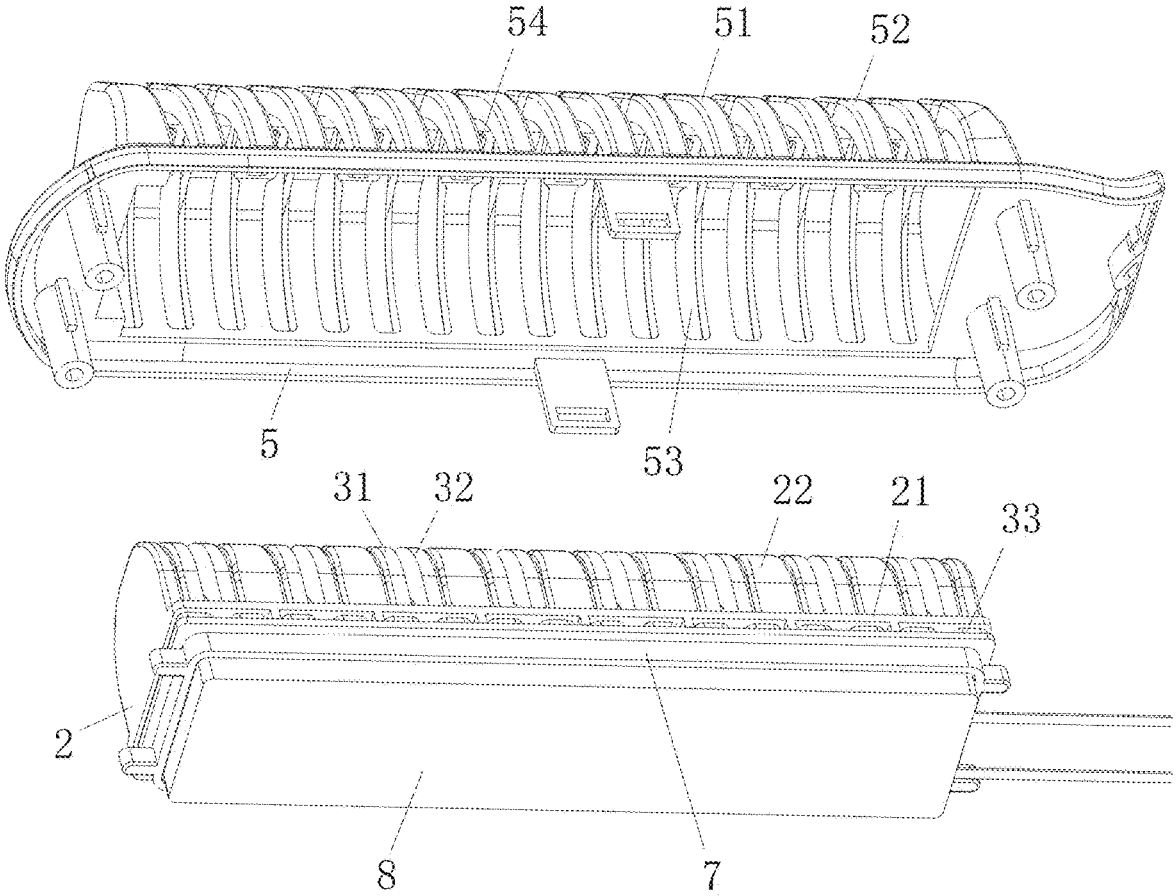
FIG. 4 is a diagram of the matching structure between the combination of the comb strips and the elastic teeth, and the comb cover.
Figure 5:
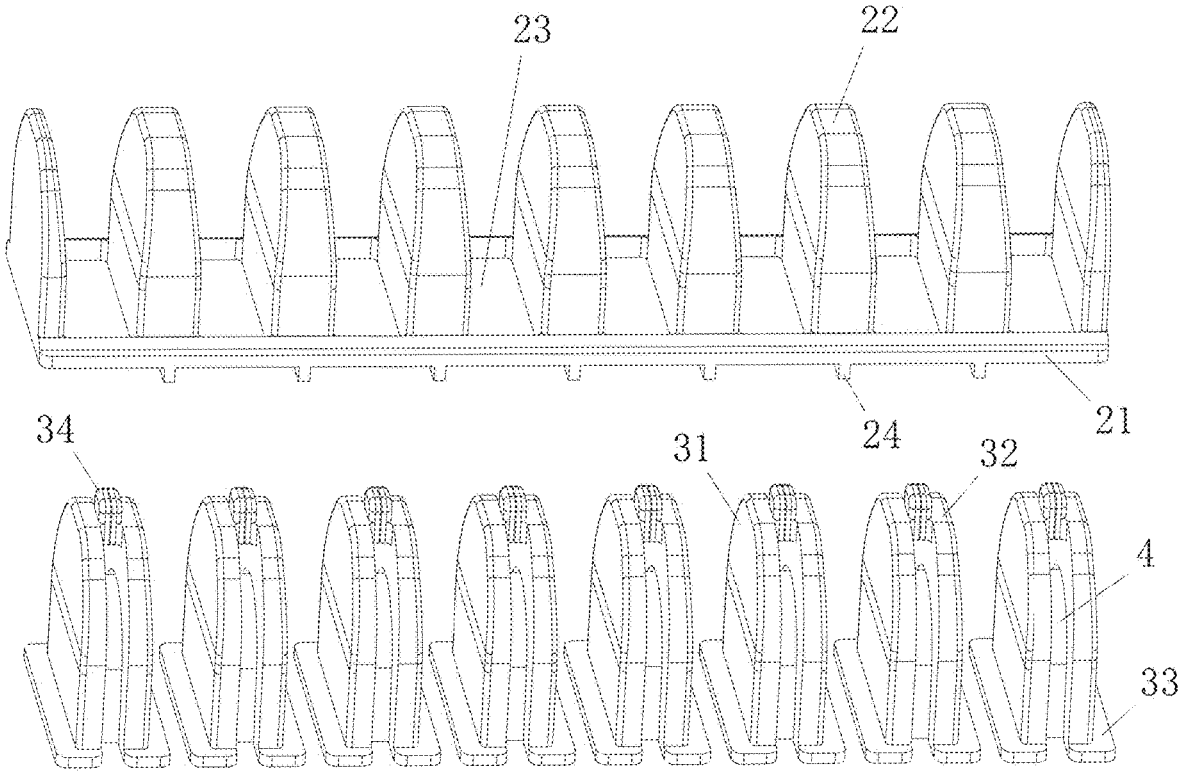
FIG. 5 is an exploded structural diagram of the elastic teeth and the comb strips.
Figure 6:
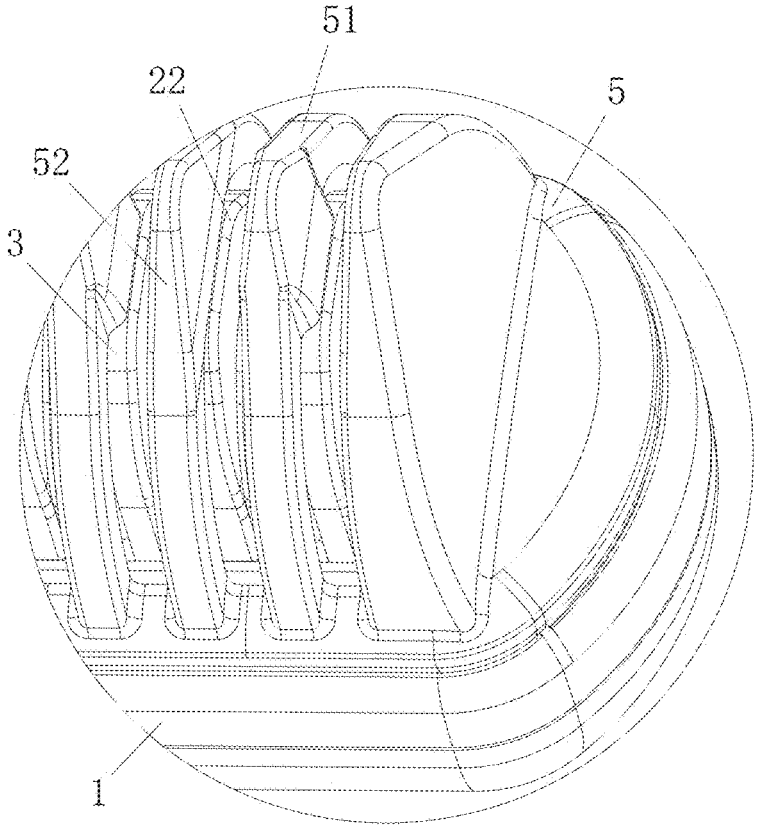
FIG. 6 is an enlarged partial view of FIG. 1.

In the present embodiment, referring to FIG. 1-6, said straightening comb with elastic floating teeth comprises a shell, a heater 8, a tooth assembly, a control switch and a circuit board, wherein the heater 8 is connected to the circuit board, said tooth assembly comprises fixed and elastic teeth 22, 3, the fixed teeth 22 are installed fixedly in the shell, and the elastic teeth 3 are installed movably in the shell, and each elastic tooth 3 is opposite to a fixed tooth 22; an elastic component is provided on the side of each elastic tooth 3, and presses against the side of the elastic tooth 3, allowing the elastic tooth 3 to move closer to or farther away from the fixed tooth 22; the upper part of at least one of the elastic teeth 3 and fixed teeth 22 is an inclined structure to provide a gap that accommodates the hair between the elastic and fixed teeth.

Said fixed teeth 22 are provided on a comb strip 2, and the lower two sides of several fixed teeth 22 are connected into an integrated structure through a fixing frame 21; there is a tooth hole 23 between two adjacent fixed teeth 22, and the elastic teeth 3 extend from the tooth holes 23 opposite the fixed teeth 22.

A group of elastic teeth 3 is provided in each tooth hole 23, each group of elastic teeth 3 comprises symmetrically arranged left teeth 31 and right teeth 32, that is, one fixed tooth is matched with two elastic teeth; the left teeth 31 are opposite to the right side of the fixed teeth 22, and the right teeth 32 are opposite to the left side of the fixed teeth 22; an elastic component is provided between the left and right teeth 31, 32, and also presses against the opposite sides of the left and right teeth 31, 32 to form a structure that can push the left and right teeth 31, 32 simultaneously to move to the left and right sides simultaneously.

It further comprises a comb cover 5, and the comb cover 5 is provided with a partition cover 51 and a partition tooth 52. There is a gap between the partition cover 51 and the partition tooth 52 to form a combing groove 53, and each combing groove 53 corresponds to a gap for accommodating hair.

The shell comprises a first shell 11 and a second shell 12, the comb cover 5 is provided on the first shell 11, the partition cover 51 is alternated with the partition teeth 52 to cover the elastic teeth 3, and the partition teeth 52 cover the fixed teeth 22.

Protruding stop lugs 34 are provided at the top of the elastic teeth 3, stop grooves 54 matching the stop lugs 34 are provided inside the top of the partition cover 51, and the stop lugs 34 are inserted into the stop grooves 54; the size of a stop groove 54 is larger than that of a stop lug 34, so that the stop lug 34 can move within the stop groove 54 to restrict the moving range of the elastic teeth 3.

A partition strip 34 is provided along each fixed tooth 22, has the same direction as that of the fixed tooth, and extends to the bottom surface of the fixing frame 21 on both sides; support feet 33 are provided on the bottom surface of the elastic teeth 3, and blocked by the space formed by the fixing frame 21 and the partition strips 24, so that the elastic teeth 3 can only move leftward and rightward.

The heater 8 is fixed through a fixing cover 6, and the fixing cover 6 seizes the fixing frame 21 of the comb strip 2; a heat conducting plate 7 is provided next to the heater 8, and in contact with all fixed and elastic teeth 22, 3 through a partition strip 24 and a support leg 33 respectively to form a heat conducting structure; the fixing cover 6 is made of aluminum alloy.

The fixed and elastic teeth 22, 3 extend from the first shell 11, and the second shell 12 covers the bottom surface of the fixing cover 6.

The elastic component uses silicone blocks 4 (or springs).

Since a silicone block 4 is elastic, it pushes open the left and right teeth 31, 32 toward both sides as much as possible under its elastic force, so that the gap between the elastic tooth 3 and the fixed tooth 22 for accommodating hair is minimized, when it suitable for fine hair. When the targeted hair is coarser or thicker, the hair will press the left tooth 31 and/or the right tooth 32, so that the left tooth 31 and/or the right tooth 32 presses the silicone block 4, which will enlarge the gap for accommodating the hair and reduce the pressure on the hair. This can prevent insufficient hair straightening due to excessively low pressure, and also prevent hair breakage due to excessively high pressure.

The present disclosure has been described above in detail. The above description is for a preferred embodiment of the present disclosure only, and does not restrict the scope of implementation of the present disclosure, that is, all equivalent changes and modifications made pursuant to the scope of the present application should still be within the scope of the present disclosure.

What is claimed is:

1. A straightening comb with elastic floating teeth, comprising:

a shell, a heater, a tooth assembly and a circuit board, wherein the heater is connected to the circuit board, the tooth assembly comprises fixed teeth and elastic teeth, the fixed teeth are installed fixedly in the shell where a tooth hole is provided between each adjacent pair of fixed teeth, and the elastic teeth are installed movably in the shell and extend within the tooth holes such that the fixed and elastic teeth alternate, where each elastic tooth comprises symmetrically arranged left and right teeth;

an elastic component disposed in each of the elastic teeth between the respective left and right teeth thereof, where each of the elastic components press against adjacent sides of the respective left and right teeth to form a structure that pushes and moves the left and right teeth simultaneously, and permits each of the elastic teeth to independently move closer to or farther away from the respective adjacent fixed tooth;

an upper part of the elastic teeth or the fixed teeth includes an inclined structure to provide a gap that accommodates hair between the elastic and fixed teeth; and wherein the elastic component is a silicone block or a spring.

2. The straightening comb with elastic floating teeth according to claim 1, wherein the fixed teeth are provided on a comb strip, and lower two sides of the fixed teeth are connected into an integrated structure through a fixing frame.

3. The straightening comb with elastic floating teeth according to claim 2, wherein the left teeth are opposite to the right side of the fixed teeth, and the right teeth are opposite to the left side of the fixed teeth.

4. The straightening comb with elastic floating teeth according to claim 1, further comprising a comb cover, having alternating partition covers and partition teeth; wherein there is a gap between each of the partition covers the respective adjacent partition tooth, where the gaps form combing grooves for accommodating hair.

5. The straightening comb with elastic floating teeth according to claim 4, wherein the comb cover is provided on the shell, the partition cover is alternated with the partition teeth to cover the elastic teeth, and the partition teeth cover the fixed teeth.

6. The straightening comb with elastic floating teeth according to claim 4, wherein protruding stop lugs are provided at the top of the elastic teeth, stop grooves matching the stop lugs are provided inside the top of the partition cover, and the stop lugs are inserted into the stop grooves; the size of the stop grooves is larger than the size of the stop lugs, so that each of the stop lugs can move within the respective stop groove.

7. The straightening comb with elastic floating teeth according to claim 2, wherein a partition strip is provided along each fixed tooth and extends in the same direction as that of the fixed tooth, such that each partition strip extends to the bottom surface of the fixing frame on both sides; and support feet are provided on the bottom surface of the elastic teeth.

8. The straightening comb with elastic floating teeth according to claim 7, wherein the heater is fixed through a fixing cover, and the fixing cover clamps the fixing frame of the comb strip; a heat conducting plate is provided next to the heater, and in contact with all fixed and elastic teeth through the partition strip and the support feet respectively to form a heat conducting structure; the fixing cover is made of aluminum alloy.

9. The straightening comb with elastic floating teeth according to claim 8, wherein the shell comprises a first shell and a second shell, and the fixed and elastic teeth extend from the first shell, and the second shell covers the bottom surface of the fixing cover.

* * * * *